United States Patent [19]

Wedel

[11] 4,440,214

[45] Apr. 3, 1984

[54] HEAT TRANSFER ROLL AND METHOD

[75] Inventor: Gregory L. Wedel, Beloit, Wis.

[73] Assignee: Beloit Corporation, Beloit, Wis.

[21] Appl. No.: 154,946

[22] Filed: May 30, 1980

[51] Int. Cl.[3] ..... F28F 5/02

[52] U.S. Cl. ..... 165/90; 165/100; 165/139

[58] Field of Search ..... 165/89, 90, 91, 100, 165/139

[56] References Cited

U.S. PATENT DOCUMENTS

| | | | |
|---|---|---|---|
| 1,930,808 | 10/1933 | Hulbert | 165/90 |
| 2,677,899 | 5/1954 | Ohlson et al. | 165/90 X |
| 2,697,284 | 12/1954 | Charlton et al. | 165/90 X |
| 2,919,904 | 1/1960 | Cundiff | 165/90 X |
| 2,956,348 | 10/1960 | Mueller | 165/90 X |
| 3,006,610 | 10/1961 | Siegel | 165/89 |
| 3,135,319 | 6/1964 | Richards | 165/89 |
| 3,181,605 | 5/1965 | Smith, Jr. | 165/90 |
| 3,224,110 | 12/1965 | Kroon | 165/90 X |
| 3,309,786 | 3/1967 | Conti | 165/90 X |
| 3,419,068 | 12/1968 | Grierson | 165/89 |
| 3,581,812 | 6/1971 | Fleissner et al. | 165/89 |
| 3,583,687 | 6/1971 | Nakahara et al. | 165/90 X |
| 3,604,237 | 9/1971 | Kawanami et al. | 165/89 X |
| 3,633,662 | 1/1972 | Voll | 165/89 |
| 3,643,344 | 2/1972 | Strube | 165/89 X |
| 3,765,189 | 10/1973 | Le Diouron | 165/91 X |
| 3,794,118 | 2/1974 | Bauch | 165/90 |
| 3,838,734 | 10/1974 | Kilmartin | 165/90 |
| 4,050,897 | 9/1977 | Klein | 165/90 X |
| 4,120,349 | 10/1978 | Alheid | 165/89 |
| 4,252,184 | 2/1981 | Appel | 165/90 |

*Primary Examiner*—Sheldon J. Richter

*Attorney, Agent, or Firm*—Hill, Van Santen, Steadman, Chiara & Simpson

[57] ABSTRACT

A means and method for attaining desired temperature conditions at not only the major extent of the heat transfer surface of a rotary heat transfer roll but also at the edges of the roll. Temperature conditioning fluid is introduced and distributed in part directly into a first end of an annular passage between an inner and an outer roll shell and in part into the annular passage adjacently downstream relative to the first end. Spent conditioning fluid is evacuated from the second end of the passage in part directly from the second end of the annular passage and in part through the inner shell adjacently upstream relative to the second end. While the roll is continuously rotating, the relative temperature conditioning effect of the conditioning fluid is adapted to be selectively controlled in respect to either or both ends of the temperature fluid circulating annular passage in the roll.

26 Claims, 4 Drawing Figures

HEAT TRANSFER ROLL AND METHOD

BACKGROUND OF THE INVENTION

This invention relates to the art of effecting heat transfer between the perimeter of a rotary roll and a web travelling in contact with the perimeter, and is more particularly concerned with improvements attaining control of the heat transfer capability throughout the length of the heat transfer roll.

Uniform transfer of heat from a rotating roll to a web is required in many applications, both within and outside of the paper industry. Sometime adjustable or differential heat transfer along the length of the roll may be required for special applications. Numerous attempts have heretofore been made to attain these ends, some employing very complex mechanical designs, and others more simple designs. Representative of the present state of the art are the following U.S. Pat. Nos.: 2,677,899; 2,697,284; 2,919,904; 2,956,348; 3,838,734-all disclosing relatively simple heat transfer roll arrangements but without the fluid distribution control capability of the present invention.

U.S. Pat. Nos.: 3,224,110; 3,309,786; 3,419,068; 3,581,812; 3,633,662; 3,643,344; 4,120,349-all disclose more complex arrangements, but without the fluid distribution controlling capability of the present invention.

More particularly, none of the listed patents provides for the control of roll edge temperature, that is the temperature at the opposite extremities of the outer or web contacting perimeter of the shell of the roll assembly, relative to or in combination with the heat transfer temperature of the greater intermediate portion of the heat transfer perimeter of the roll.

SUMMARY OF THE INVENTION

An important object of the present invention is overcome certain disadvantages, drawbacks, inefficiencies, shortcomings and problems inherent in prior heat transfer rolls.

Another object of the invention is to provide a new and improved heat transfer roll and method for effecting heat transfer attaining efficient control of fluid distribution at the opposite extremities of the heat transfer surface of the roll as well as the intermediate area of the heat transfer surface.

A further object of the invention is to provide a new and improved method of and means for controllirg the roll edge temperature of heat transfer rolls.

Still another object of the invention is to provide a new and improved method of and means for effecting on-the-run control of edge temperature in a heat transfer roll The present invention provides in combination in a rotary heat transfer roll having concentric inner and outer differential diameter tubular shells defining an annular passage therebetween, roll heads closing opposite first and second ends of said passage, and means at said roll heads for mounting the roll rotatably for running on the perimeter of said outer shell of a travelling web to be temperature conditioned, means for introducing and distributing temperature conditioning fluid through said first end roll head, in part directly into said first end of said annular passage and in part through said inner shell into said annular passage adjacently downstream relative to said first end to join said directly introduced conditioning fluid and then to pass through said annular passage towards said second end, and means for evacuating spent conditioning fluid from said second end through said second end roll head, in part directly from said second end of said annular passage and in part through said inner shell adjacently upstream relative to said second end. Means are desirably provided, adapted to be operated while the roll is continuously rotating, for selectively controlling the relative temperature conditioning effect of both parts of the conditioning fluid in respect to either said first end or said second end or both ends of said passage.

The invention also provides a new and improved method of controlling heat transfer in a rotary heat transfer roll having concentric inner and outer differential diameter tubular shells defining an annular passage therebetween, roll heads closing opposite first and second ends of said passage, and means at said roll heads for mounting the roll rotatably for running on the perimeter of said outer shell of a travelling web to be temperature conditioned, comprising introducing and distributing temperature conditioning fluid through said first end roll head, in part directly into said first end of said annular passage and in part through said inner shell into said annular passage adjacently downstream relative to said first end and thereby joining with said directly introduced conditioning fluid, circulating the joined conditioning fluid through said annular passage toward said second end, and evacuating spent conditioning fluid from said second end through said second end roll head, in part directly from said second end of said annular passage and in part through said inner shell adjacently upstream relative to said second end. While the roll rotates continuously, selective controlling of the relative temperature conditioning effect of both parts of the conditioning fluid may be effected with respect to either said first end or said second end or both ends of said passage.

BRIEF DESCRIPTION OF THE DRAWINGS

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

DETAILED DESCRIPTION OF PREFERRED EMBODIMENTS

Figure 1:
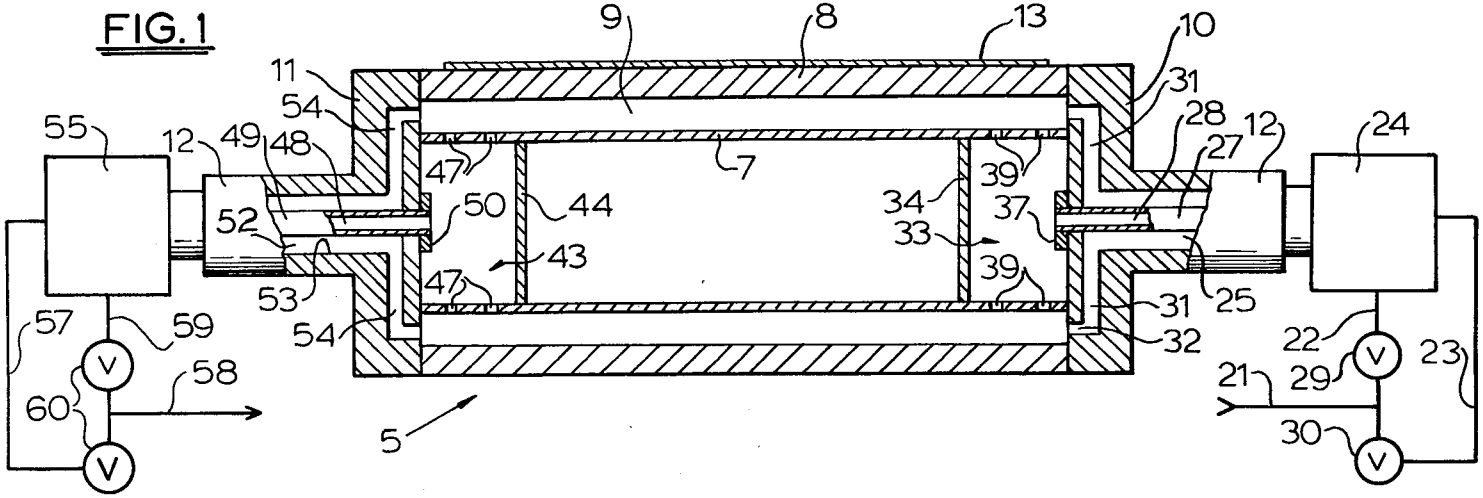
FIG. 1 is a longitudinal schematic sectional elevational view of a heat transfer roll embodying the invention.

A rotary heat transfer roll 5 (FIG. 1) embodying the present invention has concentric inner and outer differential diameter tubular shells 7 and 8, respectively, defining an annular passage 9 therebetween. A first roll head 10 closes a first end of the shells 7 and 8 and the passage 9, and a second roll head 11 closes the opposite second end of the shells 7 and 8 and the passage 9. Each of the roll heads 10 and 11 has means such as a journal 12 for mounting the roll 5 rotatably for running on the perimeter of the outer shell 8 of a travelling web 13 to be temperature conditioned.

Although the roll shells 7 and 8 may be attached in endwise abutting relation to the inner faces of the roll heads 10 and 11 as shown in FIG. 1, a preferred assembly comprises mounting of the first end of the inner shell 7 within a rabbet groove 14 provided therefor on an inwardly projecting hub 15 on the roll head 10. Attachment of the first end of the outer shell 8 to the roll head 10 is adapted to be effected by engaging such end in a complementary rabbet groove 17 in the inner face of a radially outer annular portion of the head 10. Similarly, the second end of the inner shell 7 is adapted to be engaged in a complementary rabbet groove 18 in an inwardly projecting hub 19 on the head 11. At its second end, the outer shell 8 is fixed to the head 11 in a complementary rabbet groove 20 in the inner face of a radially outer portion of the head 11.

Means are provided for supplying temperature conditioning fluid through the first head 10 to circulate through the annular passage 9 and then to be evacuated through the second roll head 11. More particularly, the supplied and circulated temperature conditioning fluid is controlled to attain a desired heat transfer relationship of the roll edges, that is at the ends of the outer shell 8 with respect to the intermediate, major length of the outer shell. To this end, the temperature conditioning fluid may be supplied at a given desirable temperature from a suitable source through a supply line 21 to a pair of line branches 22 and 23 which connect through a siphon type rotary joint 24 with passageway means leading through the journal 12 of the head 10 to the inner end of the head. In a preferred arrangement, the branch 22 communicates through the joint 24 with a passageway 25 formed concentrically longitudinally through the journal 12 and of a diameter to accommodate in clearance relation a smaller diameter concentric tube 27 providing a passageway 28 with which the branch 23 is connected. Control over the volume of conditioning fluid delivered into the first end of the roll 5 is by means of valves 29 and 30 in respectively the lines 22 and 23.

Figure 2:
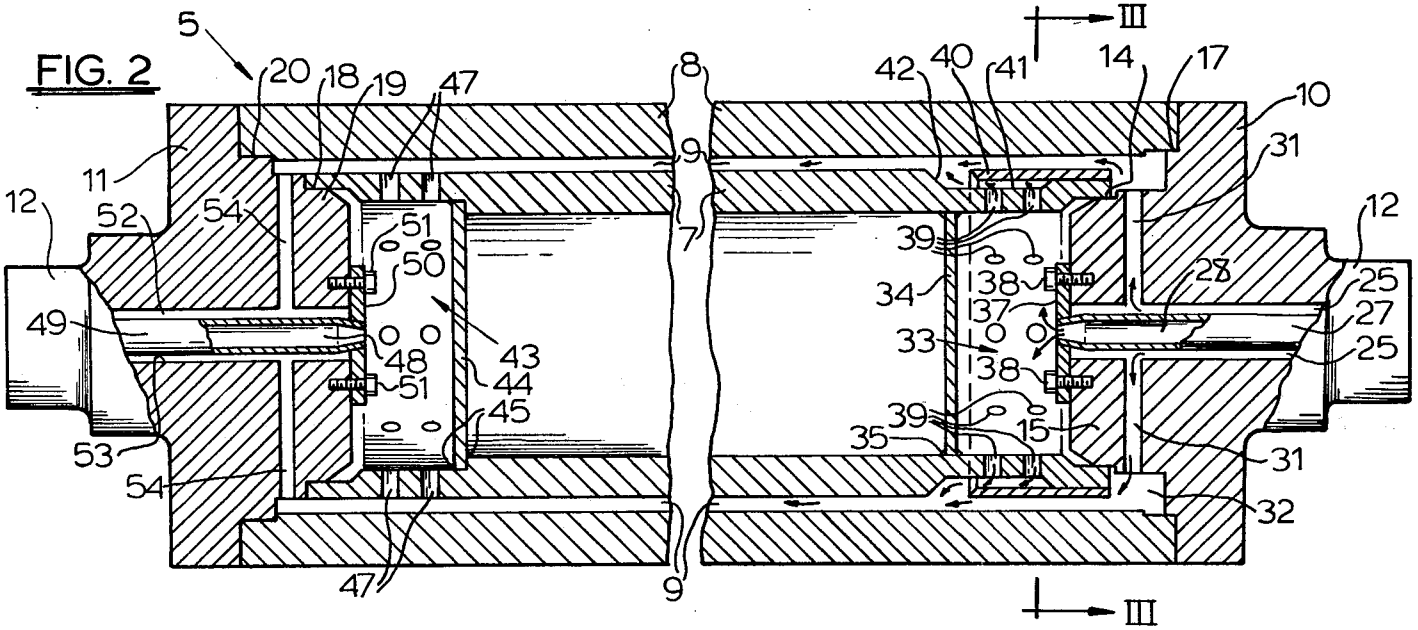
FIG. 2 is a fragmental enlarged longitudinal sectional view through the heat transfer roll showing structural parts and relationships in greater detail.
Figure 3:
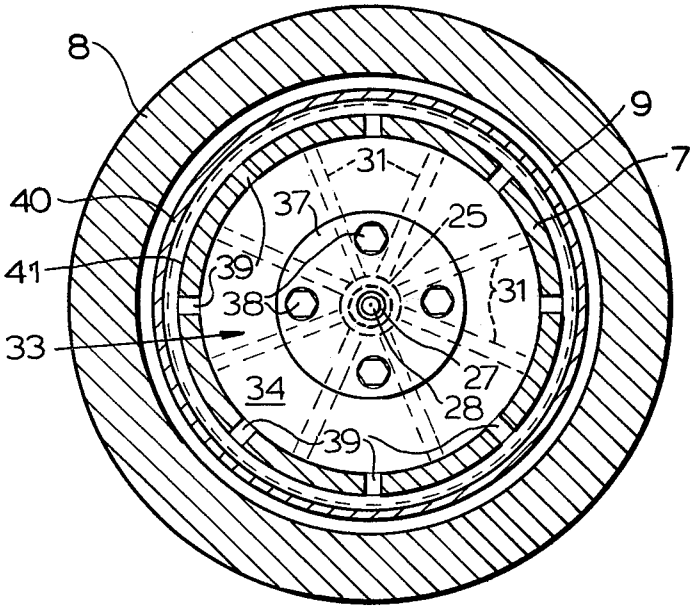
FIG. 3 is a vertical sectional view taken substantially along the line III—III of FIG. 2.

Conditioning fluid from the passageway 25 is distributed through a plurality of equidistantly spaced radial passageway branches 31 (FIGS. 1, 2 and 3) to the first end of the passage 9 in a manner to condition the temperature of the first end portion of the outer shell 8. By preference, the branches 31 discharge into an annular stilling chamber 32 defined in a space about the hub 15, the inwardly facing wall of the head 10 and the adjacent first end of the inner shell 7, at the first or upstream end of the passage 9.

Conditioning fluid delivered to the passageway 28 discharges into a fluid reception chamber 33 defined between the inner end of the head hub 15 and a partition 34 spaced in a limited distance inwardly from the hub and secured as by means of welding 35 in sealing relation across the interior of the shell 7. At its inner end, the tube 27 is secured in place as by means of a flange 37 fixedly secured to the tube and attached to the inner end of the hub 15, as by means of screws 38.

For effecting communication between the chamber 33 and the annular heat transfer passage 9, ports 39 extend through the wall of the inner shell 7. For maximum efficiency, annularly arranged equidistantly spaced sets of the ports 39 are provided. Discharge from the ports 39 is prevented from impinging directly from the ports onto the outer shell 8, and for this purpose an annular baffle 40 is mounted on the adjacent end portion of the inner shell 7 and extends inwardly over an annular distribution groove 41 into which the ports 39 discharge. The baffle 40 directs the fluid from the ports 39 downstream and at relatively low velocity from an annular orifice defined between the end of the baffle and an annular lead-out surface 42 sloping in a downstream direction at the inner end of the groove 41. Thereby the fluid passes smoothly from the flaringly chamfered free end of the baffle into the passage 9 where the fluid joins, mixes with, and circulates downstream with the fluid which was directly introduced into the first end of the passage 9 in heat transfer relation to the first end of the outer shell 8 at the stilling chamber 32 and flows with substantially uniform velocity to join the treating fluid issuing from the annular orifice defined at the exit end of the baffle 40. Thence, the joined and mixed increments of the conditioning fluid circulate downstream through the passage 9 in heat transfer relation to the major intermediate extent of the outer shell 8 and toward the second end of the passage 9 at the roll head 11.

Evacuation of spent conditioning fluid is effected through the roll head 11, in part directly from the second end of the passage 9 and in part through and from a second reception chamber 43 similar to the first reception chamber 33 but with fluid flow in reverse direction. That is, the chamber 43 is defined between a partition 44 sealingly secured as by means of welding 45 across the interior of the inner shell 7 in suitably adjacently spaced relation to the inner end of the roll head 11 and more particularly the hub 19. Communication between the second or downstream end portion of the passage 9 and the chamber 43 is effected through second ports 47 (as distinguished from the first ports 39) and desirably in a similar arrangement as the ports 39 comprising two annular rows of the ports 47 extending radially through the wall of the inner shell 7. From the chamber 43 the spent fluid is drawn off through a passageway 48 in a tube 49 extending through the head 11, and which has its entry end in communication with the chamber 43 and is supported by an attachment flange 50 secured to the inner end of the hub 19 as by means of screws 51.

To provide a passageway 52 for communication through the roll head 11 with the downstream end of the chamber 9, a bore 53 of larger diameter than the tube 49 extends axially through the head 11 and is closed at its inner end by the flange 50. Communication between the passageway 52 and the second, downstream end of the passage 9 is effected by means of a plurality of circumferentially spaced radial branch passageways 54 through the hub 19.

From the outer end of the journal 12 of the roll end 11, the passageways 48 and 52 communicate with a siphon-type rotary joint 55. From the joint 55 the passageway 48 communicated by way of a branch line 57 with an evacuation line 58, and the passageway 52 communicated by way of a branch line 59 with the evacuation line 58. Each of the branch lines 57 and 59 desirably has a respective control valve 60.

From the foregoing it will be apparent that means are provided for attaining substantially improved heat transfer control, especially at the roll edges, that is at the opposite ends of the outer, heat transfer roll shell 8. For this purpose, the upstream or supply control valves 29 and 30 and the downstream or evacuation control valves 60 provide means for adjusting the divided conditioning flow increments at the first or upstream end of the roll and at the second or downstream end of the roll throughout a very wide range. While often as nearly as practicable uniformity of heat transfer throughout the length of the heat transfer passage 9 may be desired, operating conditions, and more particularly variations in requirements for the travelling web 13 may require adjustments in the heat transfer ratios between either or both of the roll edges and the intermediate span of the heat transfer surface provided by the outer shell 8. For example, if it is necessary to increase the heat transfer function at the first or upstream edge of the heat transfer surface relative to the remainder of the heat transfer surface, the valves 29 and 30 may be adjusted to increase the volume of heat transfer fluid to the stilling chamber 32 as compared to the volume delivered to and distributed from the first chamber 33. If the reverse condition is desirable, the control valves are adapted to be adjusted to increase the volume of temperature conditioning fluid to the chamber 33 relative to the volume of conditioning fluid supplied to the stilling chamber 32. Similarly, at the downstream or second end of the heat transfer roll, effective control is attained by means of the control valves 60. If increased heat transfer is desired at the second or downstream roll edge, the volume of heat transfer fluid evacuated through the passageway 52 is increased relative to the volume increment of the fluid evacuated through the chamber 43. For a reverse condition, the incremental volumes of the heat transfer fluid evacuated through the respective passages 52 and 48 may be reversed. It will be understood that the heat transfer fluid may either be a heated fluid for transferring heat through the outer shell 8, or it may be a heat reducing or chilling fluid for effecting a reverse heat transfer function, that is to chill the heat transfer surface of the outer shell 8. In either case efficient heat transfer control is attainable not only along the major extent of the heat transfer surface but also at each end of the heat transfer surface, that is at each edge of the heat transfer roll, by adjusting the flow rate ratio between the roll edge areas and the intermediate areas of the heat transfer surface.

Figure 4:
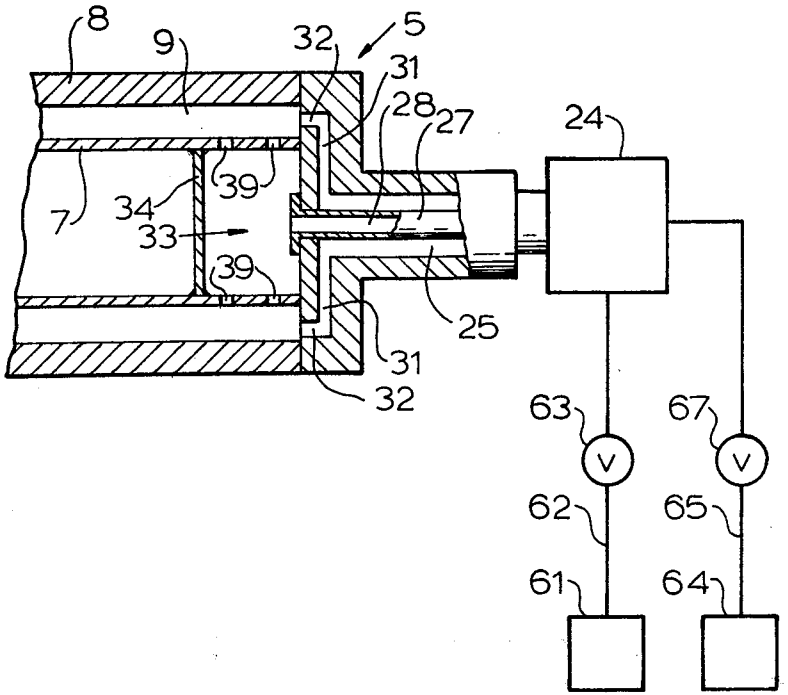
FIG. 4 is a fragmentary longitudinal schematic sectional elevational view of the heat transfer roll showing a modified conditioning fluid control.

If operating conditions require a wider range of temperature control of the outer shell heat transfer surface than may be attainable by supplying the heat transfer fluid from a common source for each of the divided increments, separate differential temperature fluid sources may be employed as indicated in FIG. 4. Thus, a fluid source 61 may be provided communicating by way of a line 62 through a control device such as a valve or orifice 63 and by way of the rotary joint 24 with the passageway delivering to the upstream end of the heat transfer passage 9 by way of the stilling chamber 32. A separate heat transfer source 64 supply by way of a line 65 and a control device 67 through the joint 24 to the passageway 28 delivers to the receiving chamber 33 For heating heat transfer the temperatures of the heat transfer fluid from the respective sources 61 and 64 may vary to any extent desired. To the same effect where chilling function is desired, the chill factor of the fluid supplied from the respective sources 61 and 64 may be in whatever differential required At the second or downstream end of the heat transfer roll 5, a similar arrangement as in FIG. 1 may be employed unless the flow rate ratios required cannot be handled through a common evacuation line, or it is desired to return the evacuated fluid separately to the respective sources for recycling.

While any of the control devices 29, 30 and 60 in FIG. 1, and 63 and 67 in FIG. 4 may be manually adjusted, it will be apparent that means for automatic adjustment may readily be provided under the control of temperature sensors, or the like. Advantageously, the adjustments can be effected on the run and without stopping the heat transfer roll 5.

It will be understood that variations and modifications may be effected without departing from the spirit and scope of the novel concepts of this invention.

I claim as my invention:

1. In combination in a rotary heat transfer roll having concentric inner and outer differential diameter tubular shells defining an annular passage therebetween, roll heads closing opposite first and second ends of said passage, and means at said roll heads for mounting the roll rotatably for running on the perimeter of said outer shell of a travelling web to be temperature conditioned:

means for introducing and distributing temperature conditioning fluid through said first end roll head, in part directly into said first end of said annular passage and in part through said inner shell into said annular passage adjacently downstream relative to said first end to join said directly introduced conditioning fluid and then to circulate through said annular passage towards said second end; and means for evacuating spent conditioning fluid from said second end through said second end roll head, in part directly from said second end of said annular passage and in part through said inner shell adjacently upstream relative to said second end.

2. A rotary heat transfer roll according to claim 1, including respective partitions extending in sealing relation across the interior of said inner shell adjacently spaced from its first and second ends and defining between the partions and the respective adjacent roll heads first and second fluid reception chambers, said first chamber receiving therein that part of the temperature conditioning fluid introduced and distributed through said inner shell into said annular passage, and said second chamber having communication with said annular passage through said inner shell and thereby receiving from said annular passage spent conditioning fluid through said inner shell as part of said evacuating means.

3. A rotary heat transfer roll according to claim 2, including an annular flow controlling baffle extending in spaced relation about the area of said inner shell through which said first chamber communicates with said annular passage and thereby preventing direct impingement on said outer shell by the conditioning fluid entering said annular passage from said first chamber.

4. A rotary heat transfer roll according to claim 1, including an annular stilling chamber at said first end of said passage and into which the conditioning fluid for said first end of the passage is introduced.

5. A rotary heat transfer roll according to claim 1, including means operative while the roll is continuously rotating for selectively controlling the relative temperature conditioning effect of the conditioning fluid in respect to at least said first end of said passage.

6. In combination in a rotary heat transfer roll having concentric inner and outer differential diameter tubular shells defining an annular passage therebetween, roll heads closing opposite first and second ends of said shells and of said passage, and means at said roll heads for mounting the roll rotatably for running on the perimeter of said outer shell of a travelling web to be temperature conditioned:

respective partitions extending in sealing relation across the interior of said inner shell adjacently spaced from its first and second ends and defining between the partitions and the respective adjacent roll heads first and second fluid reception chambers;

first ports extending through the wall of said inner shell and effecting communication between said first chamber and said annular passage;

second ports extending through the wall of said inner shell and effecting communication between said annular passage and said second chamber;

means for introducing and distributing temperature conditioning fluid through said first end roll head, in part directly into said first end of said annular passage and in part into said first reception chamber for delivery therefrom through said first ports into said annular passage to join said directly introduced conditioning fluid and then to circulate through said annular passage toward said second end;

and means for evacuating spent conditioning fluid through said second end roll head, in part directly from said second end of said annular passage and in part through said second ports into and then from said second chamber.

7. A rotary heat transfer roll according to claim 6, including an annular baffle in spaced relation about the exit ends of first ports and arranged to direct the conditioning fluid downstream into said passage.

8. A rotary heat transfer roll according to claim 6, including an annular stilling chamber at said first end of said annular passage.

9. A rotary heat transfer roll according to claim 6, including an annular stilling chamber at said first end of said annular passage, and means for baffling the conditioning fluid leaving said first ports and thereby directing such conditioning fluid to join the directly introduced conditioning fluid in a downstream circulating direction in said passage.

10. A rotary heat transfer roll according to claim 6, including means adapted to be operated while the roll is continuously rotating for selectively controlling the relative temperature conditioning effect of the conditioning fluid in respect to at least said first end of said passage.

11. A rotary heat transfer roll according to claim 6, wherein said means for introducing and distributing temperature conditioning fluid comprises separate passageways communicating with a common fluid source, one of said passageways communicating directly with said first end of said annular passage and the other of said passageways communicating with said first chamber, and means for selectively and individually controlling flow from said source through said passageways.

12. A rotary heat transfer roll according to claim 6, wherein said means for introducing and distributing temperature conditioning fluid comprises separate passageways, one of which communicates with said first end of said annular passage and the other communicating with said first reception chamber, separate conditioning fluids supply sources for said passageways, and means for selectively controlling fluid flow through said passageways.

13. A rotary heat transfer roll according to claim 6, including means adapted to be operated while the roll is continuously rotating for selectively controlling the relative temperature conditioning effect of the conditioning in respect to both said first end and said second end of said passage.

14. A method of controlling heat transfer in a rotary heat transfer roll having concentric inner and outer differential diameter tubular shells defining an annular passage therebetween, roll heads closing opposite first and second ends of said passage, and means at said roll heads for mounting the roll rotatably for running on the perimeter of said outer shell of a travelling web to be temperature conditioned, and comprising:

introducing and distributing temperature conditioning fluid through said first end roll head, in part directly into said first end of said annular passage and in part through said inner shell into said annular passage adjacently downstream relative to said first end and thereby joining with said directly introduced conditioning fluid;

passing the joined conditioning fluid through said annular passage toward said second end; and evacuating spent conditioning fluid from said second end through said second end roll head, in part directly from said second end of said annular passage and in part through said inner shell adjacently upstream relative to said second end.

15. A method according to claim 13, comprising in the continuous rotation of the roll effecting selective control of the temperature conditioning effect of the conditioning fluid at either or both ends of said passage.

16. A method according to claim 14, wherein said inner shell has respective partitions extending in sealing relation across the interior of said inner shell adjacently spaced from its first and second ends and defining between the partitions and the respective adjacent roll heads first and second fluid reception chambers, both of which communicate through the wall of said inner shell with said annular passage, and comprising introducing into said first chamber that part of the temperature conditioning fluid introduced and distributed through said inner shell into said annular passage, and receiving into said second chamber that part of the spent conditioning fluid evacuated through said inner shell adjacently the upstream relative to said second end.

17. A method according to claim 16, comprising controlling the conditioning fluid passing from said first chamber through the wall of said inner shell against direct impingement of said outer shell.

18. A method according to claim 14, comprising introducing the conditioning fluid for said first end of said passage into an annular stilling chamber at said first end of said passage.

19. In a method of effecting heat transfer with a rotary heat transfer roll having concentric inner and outer differential diameter tubular shells defining an annular passage therebetween, roll heads closing opposite first and second ends of said shells and of said passage, and means at said roll heads for mounting the roll rotatably for running on the perimeter of said outer shell of a travelling web to be temperature conditioned:

sealingly partitioning the interior of said inner shell adjacently spaced from its first and second ends and thereby providing between the partitions and the respective adjacent roll heads first and second fluid reception chambers;

providing first ports through the wall of said inner shell and thereby effecting communication between said first chamber and said annular passage;

providing second ports extending through the wall of said inner shell and thereby effecting communication between said annular passage and said second chamber;

introducing temperature conditioning fluid through said first end roll head, in part directly into said first end of said annular passage and in part into said first reception chamber;

delivering the conditioning fluid from said first reception chamber through said first ports into said annular passage and there joining with the directly introduced conditioning fluid;

circulating the joined conditioning fluid through said annular passage towards said second end;

and evacuating spent conditioning fluid through said second end roll head, in part directly from said second end of said annular passage and in part through said second ports into and then from said second chamber.

20. A method according to claim 19, comprising directing in a downstream direction into said passage the conditioning fluid entering said passage through said first ports.

21. A method according to claim 19, comprising introducing the conditioning fluid into an annular stilling chamber at said first end of said annular passage.

22. A method according to claim 19, including directing conditioning fluid into an annular stilling chamber at said first end of said annular passage, and directing the conditioning fluid leaving said first ports to join the directly introduced conditioning fluid in a downstream circulating direction in said passage.

23. A method according to claim 19, which comprises selectively controlling the relative temperature conditioning effect of a conditioning fluid in respect to at least said first end of said passage while said roll is continuously rotating.

24. A method according to claim 19, comprising introducing and distributing said temperature conditioning fluid through separate passageways from a common fluid source, and selectively and individually controlling flow from said source through said passageways.

25. A method according to claim 19, comprising introducing and distributing the temperature conditioning fluid through separate passageways one of which communicates with said first end of said annular passage and the other of which communicates with said first reception chamber, supplying conditioning fluid from separate supply sources to said passageways respectively, and selectively controlling fluid flow through said passageways.

26. A method according to claim 19, comprising selectively controlling the relative temperature conditioning effect of the conditioning fluid in respect to both said first end and said second end of said passageways while the roll is continuously rotating.

* * * * *